US005542313A

United States Patent [19]

McCarthy

[11] Patent Number: 5,542,313

[45] Date of Patent: Aug. 6, 1996

[54] DUAL RADIUS GEOMETRY ACCELERATOR CONTROL SYSTEM

[75] Inventor: James P. McCarthy, Fenton, Mich.

[73] Assignee: Chrysler Corporation, Auburn Hills, Mich.

[21] Appl. No.: 221,601

[22] Filed: Apr. 1, 1994

[51] Int. Cl.[6] ..... G05G 1/14

[52] U.S. Cl. ..... 74/513; 74/502.6; 74/517

[58] Field of Search ..... 74/502.4, 502.6, 74/513, 516, 517, 526, 527, 567, 569

[56] References Cited

U.S. PATENT DOCUMENTS

| | | | |
|---|---|---|---|
| 3,490,294 | 1/1970 | Antrim . | |
| 4,346,776 | 8/1982 | Taplin | 180/179 |
| 4,352,483 | 10/1982 | Iacoponi | 251/229 |
| 4,355,611 | 10/1982 | Hasegawa | 123/396 |
| 4,362,138 | 12/1982 | Krueger et al. | 123/342 |
| 4,411,845 | 10/1983 | Tanahashi et al. | 261/65 |
| 4,429,589 | 2/1984 | Stocker | 74/513 |
| 4,779,480 | 10/1988 | Stocker | 74/513 |
| 4,829,959 | 5/1989 | Terazawa | 123/349 |
| 4,848,297 | 7/1989 | Hickmann et al. | 123/342 |
| 4,862,852 | 9/1989 | Kamibayashi | 123/342 |
| 4,938,304 | 7/1990 | Yamaguchi et al. | 180/197 |
| 4,940,109 | 7/1990 | Preston et al. | 180/197 |
| 4,951,771 | 8/1990 | Maehara | 180/197 |
| 5,052,507 | 10/1991 | Luft et al. | 180/197 |
| 5,078,108 | 1/1992 | Ishikawa et al. | 123/342 |
| 5,078,111 | 1/1992 | McCann | 123/400 |
| 5,152,360 | 10/1992 | Haefner et al. | 180/197 |
| 5,263,449 | 11/1993 | Swartzendruber | 74/502.6 |

FOREIGN PATENT DOCUMENTS

| | | | |
|---|---|---|---|
| 68032 | 10/1957 | France | 74/513 |

*Primary Examiner*—Rodney H. Bonck
*Assistant Examiner*—Chong H. Kim
*Attorney, Agent, or Firm*—Margaret A. Dobrowitsky

[57] ABSTRACT

A Dual Radius Geometry Accelerator Control System is provided in which the throttle valve is made to open slowly during the off-idle range of operation then progressively faster during the mid-range operation until a maximum system actuation rate is reached. The throttle valve is then made to open at a gradually decreasing actuation rate until a local minimum actuation rate is reached at the point during the full throttle range of operation that downshifting occurs. Thereafter, the throttle valve is made to open at a substantially linear actuation rate as the control system approaches wide-open throttle. This unique throttle valve actuation scheme is achieved through an inventive control member with a dual radius design for opening the throttle valve at a non-linear actuation rate in response to the linear travel of the accelerator cable and a guide connected to the control member for contacting the accelerator cable such that, in a first range of accelerator pedal actuation, the accelerator cable contacts the guide at an engagement point to open the throttle valve at a first continuously changing actuation rate that reaches a maximum system value at a cross-over point, and in a second phase of accelerator pedal actuation, the accelerator cable pulls the control member from a pull point to open the throttle valve at a second continuously changing actuation rate that has a local minimum value.

3 Claims, 5 Drawing Sheets

| Raduis Of Rotation | Point | Throttle Valve Opening (Degrees) | Moment Arm Length (MM) |
|---|---|---|---|
| First (40) | A | 0 | 38.8 |
| First (40) | B | 10 | 36.04 |
| First (40) | C | 20 | 31.35 |
| First (40) | D | 30 | 24.46 |
| First (40) | E | 32.1 | 22.73 |
| Second (50) | F | 32.1 | 22.73 |
| Second (50) | G | 40 | 23.86 |
| Second (50) | H | 50 | 24.76 |
| Second (50) | I | 60 | 24.98 |
| Second (50) | J | 70 | 24.42 |
| Second (50) | K | 82 | 22.59 |

DUAL RADIUS GEOMETRY ACCELERATOR CONTROL SYSTEM

FIELD OF INVENTION

The present invention relates to an apparatus and method for controlling vehicle acceleration. More particularly, the invention relates to a dual radius geometry scheme which improves the driver's perception of a vehicles's driveability by establishing a non-linear relationship between the depression of the accelerator pedal and the opening of the throttle valve.

BACKGROUND

A driver's perception of a vehicle's "driveability" is greatly influenced by the response felt when depressing the accelerator pedal to open the throttle valve.

During the initial opening of the throttle valve, so called "off-idle" maneuvers such as accelerating from a stop (especially on a slippery surface) or backing up, the ideal throttle valve control system should open slowly, i.e., a minimum number of degrees for a given length of linear accelerator cable travel. Opening the throttle valve slowly during off-idle maneuvers prevents the vehicle from breaking traction or lurching forward and allows the driver to easily modulate takeoff acceleration during off-idle and low speed maneuvers.

During mid-range throttle operation, such as accelerating to merge with traffic or to pass another vehicle, the ideal throttle valve control system should open the throttle valve at a faster rate, i.e., a greater number of degrees for the same amount of linear accelerator cable travel. Opening the throttle valve at a faster rate during mid-range operation provides the driver with the perception that the vehicle is responsive and that vehicle acceleration is readily available without having to fully depress the accelerator pedal.

In vehicles with an automatic transmission, the vehicle accelerator linkage actuates a downshift circuit during full-throttle range operation. To notify the driver that downshifting is about to occur, the ideal throttle valve control system should provide the driver with a slight but discernable increase in the force required to depress the accelerator pedal before downshifting occurs. To maintain the driver's perception that the accelerator system is predictable and controllable throughout the remainder of the full-throttle range, the driver should feel an approximately linear relationship in the force required to depress the accelerator pedal and the opening of the throttle valve.

In addition, the ideal control system should provide sufficient mechanical advantage between the point that downshifting occurs and the point that wide-open throttle is obtained to allow the driver to modulate the accelerator pedal travel and feel the difference between the effort required to initiate downshifting and the effort required to obtain wide-open throttle.

SUMMARY OF INVENTION

Thus, an object of the present invention is to provide a Dual Radius Geometry Control System wherein the throttle valve is made to open slowly during the off-idle range of operation, progressively faster during the mid-range operation until a maximum system actuation rate is reached, then at a gradually decreasing actuation rate until a minimum actuation rate is reached during the full throttle range of operation. Thereafter, the throttle valve is made to open at a substantially linear rate until wide-open throttle is reached.

A further object of the invention is to provide sufficient mechanical advantage at the point that the downshift circuit is actuated to provide the driver with the ability to modulate the opening of the throttle valve at the downshift point and throughout the remainder of the full-throttle range of operation as the control system approaches wide-open throttle.

In accordance with these objectives, the present invention provides an apparatus and related method for controlling the rate at which the throttle valve of a motor vehicle is actuated. The invention includes a control member that rotates to open the throttle valve at a non-linear actuation rate in response to the linear travel of an accelerator cable. Connected to the control member is a guide means for contacting the accelerator cable at an engagement point such that, in a first range of accelerator pedal travel, the cable rotates the control member from the engagement point to open the throttle valve at a first continuously changing actuation rate that reaches a system maximum at a cross-over point. A second phase of accelerator pedal travel is initiated after the cross-over point during which the cable rotates the control member from a pull point to open the throttle valve at a second continuously changing actuation rate having a minimum value greater than the maximum system actuation rate at the crossover point.

DETAILED DESCRIPTION OF THE PREFERRED EMBODIMENT

Figure 2:
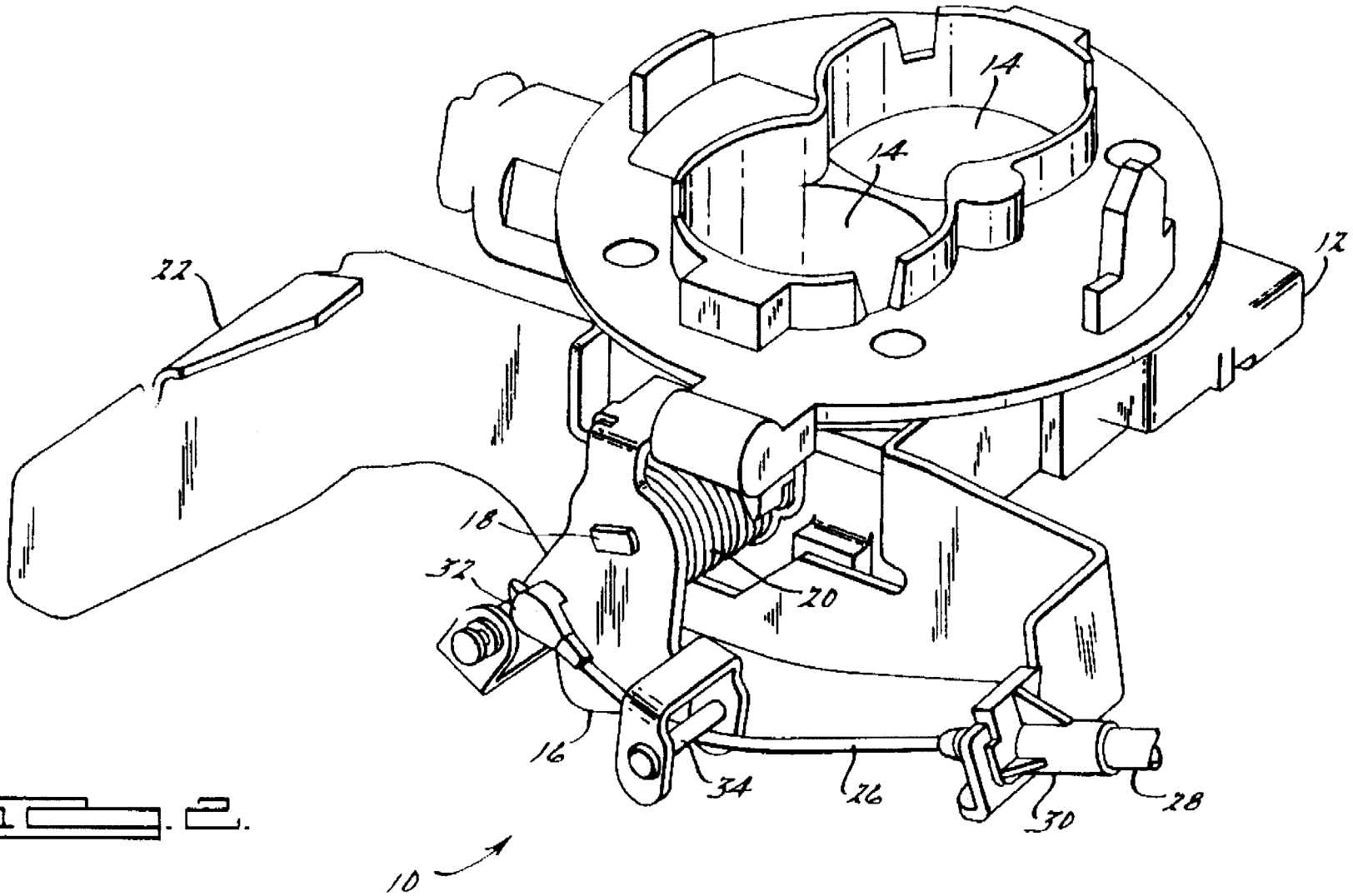
FIG. 2 is a perspective view of the Dual Radius Geometry Accelerator Control System mounted on the throttle valve body of a vehicle.

Referring now to the drawings wherein like reference numerals represent the same components among the several drawings, FIG. 2 depicts the Dual Radius Geometry Accelerator Control System 10 of the present invention mounted on a throttle valve body 12 that houses two throttle valves 14. A control member 16 is rotatably mounted on a throttle valve actuation shaft 18 that extends through the throttle valve body 12. The control member 16 rotates the throttle valve actuation shaft 18 to open the two throttle valves 14 in unison. A torsion return spring 20, positioned on the throttle valve actuation shaft 18 between the throttle valve body 12 and the control member 16, biases the control member 16 to return to the closed-throttle position shown in FIG. 2 when the driver is not stepping on the accelerator pedal (not shown). The accelerator cable 26 is routed from the accelerator pedal through an accelerator cable conduit (not shown) and an accelerator cable end fitting 30.

Figure 3:
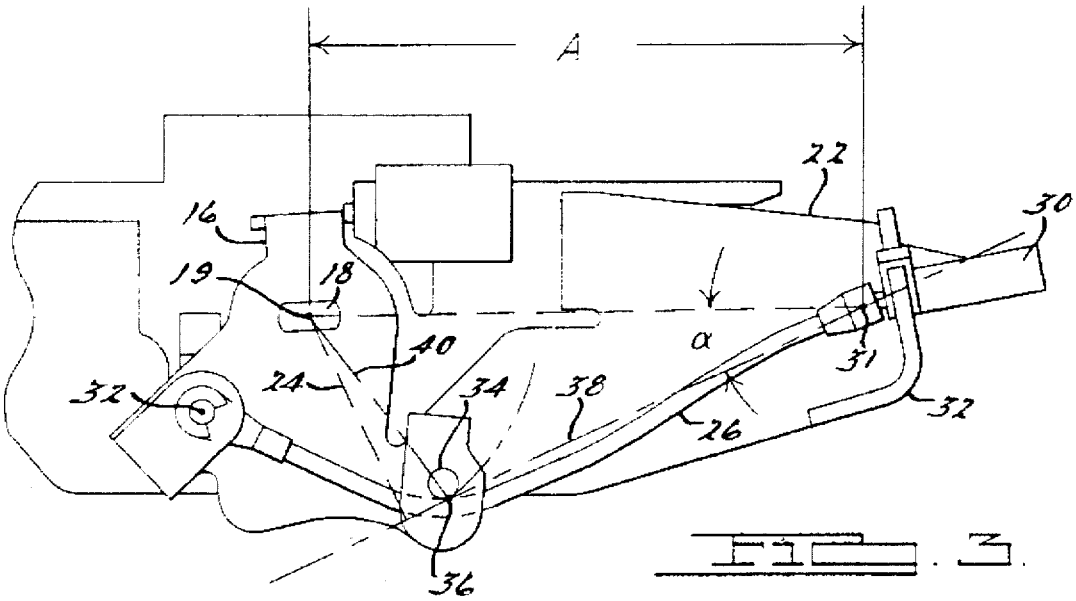
FIG. 3 is a front view of the Dual Radius Geometry Accelerator Control System of FIG. 2 showing the accelerator cable engaging the primary radius pull pin as the driver begins to step on the accelerator pedal during off-idle maneuvers.

FIG. 3 shows the accelerator cable end fitting 30 attached to an accelerator cable guide bracket 22 mounted on the throttle valve body 12. The accelerator cable end fitting 30 includes an accelerator cable pivot point 31 at which the accelerator cable 26 is guided during actuation of the accelerator pedal. After passing under a primary radius pull pin 34, the accelerator cable 26 terminates at a cable hitch 32 rotatably attached to the control member 16.

In the preferred embodiment, the primary radius pull pin 34 is offset from the centerline of the throttle valve actuation shaft 18 approximately 40 mm. The cable hitch 32 is offset from the centerline of the throttle valve actuation shaft 18 approximately 25 mm in the opposite direction as shown in FIG. 3.

As the driver depresses the accelerator pedal to begin off-idle maneuvers, the accelerator cable 26 is placed in tension at the accelerator cable hitch 32 (pull point 48) and pulled until it engages the primary radius pull pin 34 at an accelerator cable engagement point 36. A pull axis 38 is thus defined between the accelerator cable pivot point 31 and the engagement point 36. The accelerator cable 26 exerts a pull force on the primary radius pull pin 34 at the engagement point 36 that overcomes the return force of the linear torsion spring 20 to rotate the first radius pull pin 34 about the valve actuation shaft 18 along an arc traced by a first radius of rotation 40. A first moment arm 24 is created between the center point of the throttle valve actuation shaft 18 and the pull axis 38.

The length of the moment arm 24 is inversely proportional to the instantaneous rate at which the throttle valve actuation shaft 18 rotates in response to the linear travel of the accelerator cable travel and directly proportional to the mechanical advantage of the moment arm 24 i.e., its tendency to rotate the control member 16 about the throttle valve actuation shaft 18 in response to a pull force applied at the engagement point 36. In FIG. 3, if the offset distance between the throttle valve actuation shaft 18 and accelerator cable pivot point 31 is defined as offset distance A, the length of the first moment arm 24 at any instant can be calculated as the sine of the angle alpha between the pull axis 38 and the offset distance A, multiplied by the offset distance A.

Figure 1A:
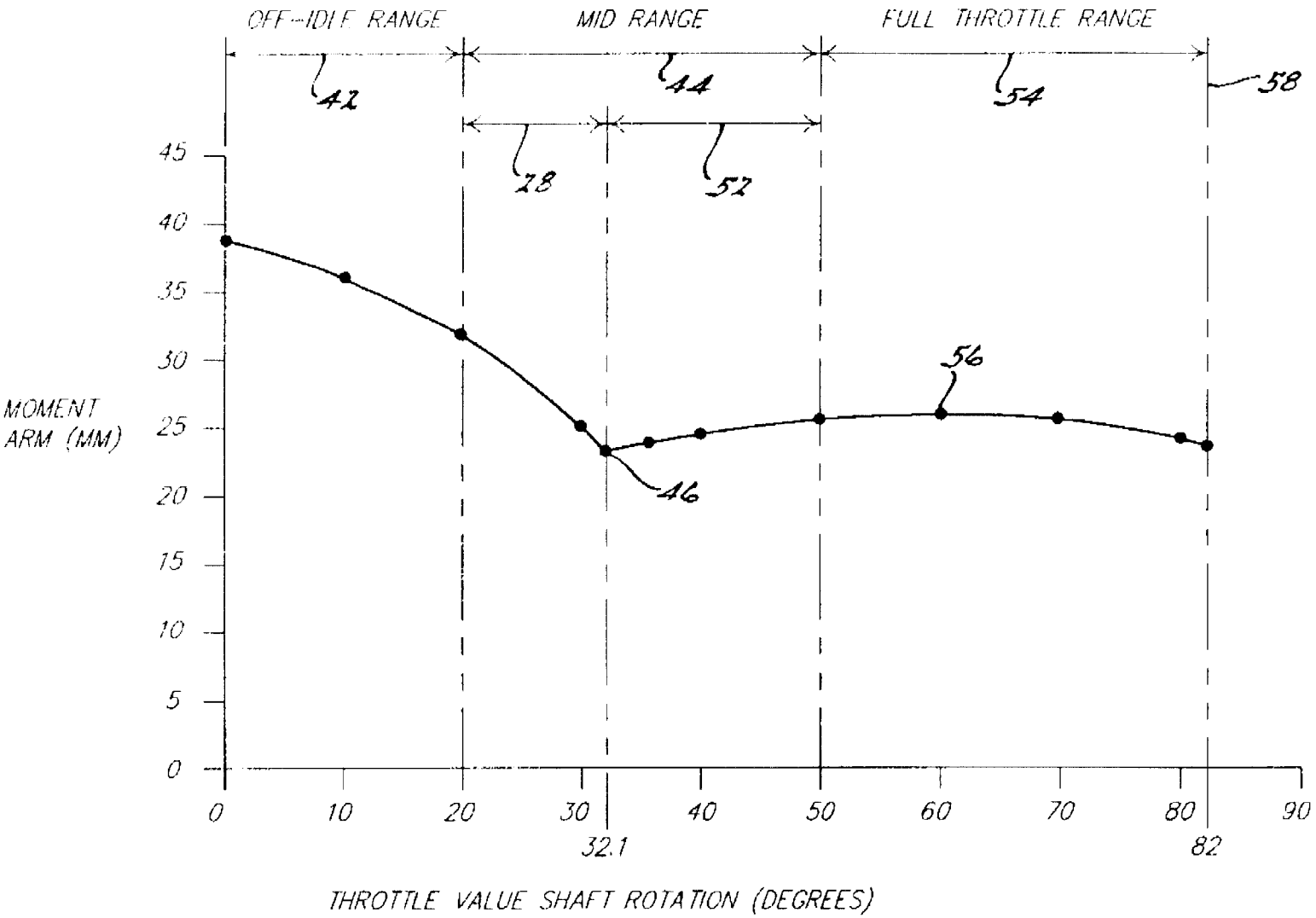
FIG. 1A is a graph representing the relationship between the length of the moment arm and the degrees of throttle valve shaft rotation for the Dual Radius Geometry Accelerator Control System.
Figure 1B:
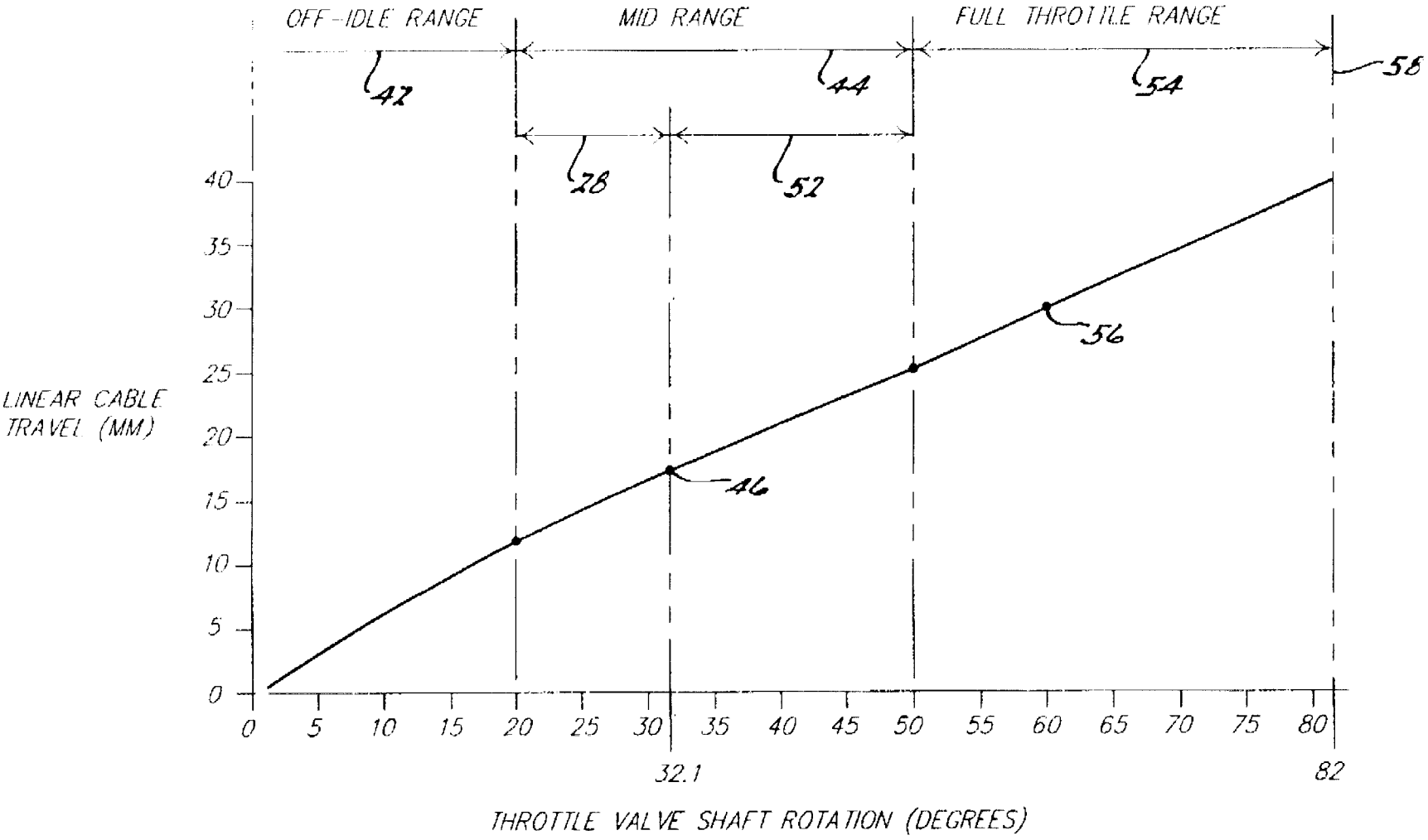
FIG. 1B is a graph representing the relationship between the linear travel of the accelerator cable and the degrees of throttle valve shaft rotation for the Dual Radius Geometry Accelerator Control System.
Figure 1C:
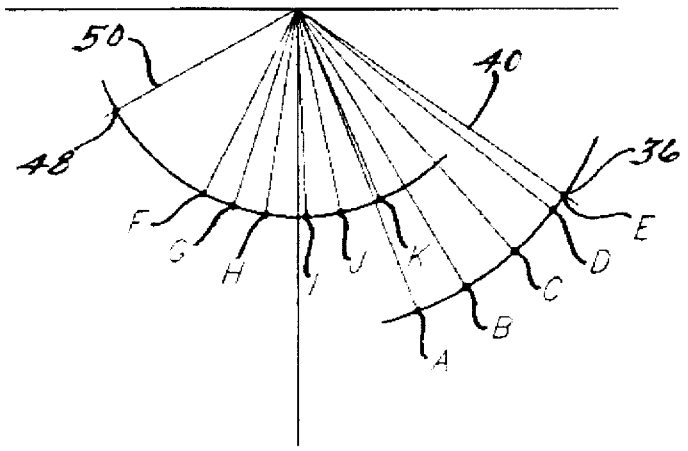
FIG. 1C is a schematic and related table showing the length of the moment arm versus the degrees of throttle valve shaft rotation for each of the two radii of rotation in the preferred embodiment.

The length of the moment arm 24, hereafter called the instantaneous throttle valve velocity T, is shown in FIG. 1A as a function of the number of degrees of rotation of the throttle valve shaft 18. Some absolute lengths of the moment arm 24 for selected degrees of rotation of the throttle valve shaft 18 in the preferred embodiment are shown in the schematic and related table of FIG. 1C. FIG. 1B graphically correlates the linear travel of accelerator cable 26 to the number of degrees of rotation of throttle valve actuation shaft for the preferred embodiment.

Referring to FIGS. 1A, 1B, 1C and 3, the off-idle range 42 of the present invention is characterized by a long moment arm 24 that opens the throttle valves 14 a relatively small number of degrees for a given linear distance of accelerator pedal travel. Thus, the throttle valve velocity T is small throughout the off-idle range 42 as the moment arm 24 continuously decreases a total of 7 mm (from approximately 39 to 32 mm) to open the throttle valves 14 twenty degrees in response to 13 mm of linear cable travel. The long length of the moment arm 24 during the off-idle range of operation 42 desensitizes accelerator pedal travel and provides the driver with vehicle controllability during initial take-off and parking maneuvers.

During the entire mid-range 44 operation of the preferred embodiment, the throttle valves 14 open a total of 30 degrees (20 to 50 degrees). Due to the more progressively decreasing length of the moment arm 24 during the initial phase of the mid-range 44 of operation, the throttle valve velocity T increases more progressively to a maximum throttle valve actuation rate which occurs at a radius of rotation cross-over point 46, a point where the primary pull pin 34 no longer makes contact with the accelerator cable 26. In the preferred embodiment, the throttle valves open from 20 to 32.1 degrees (12.1 degrees) as the moment arm 24 decreases more progressively during the pre-crossover mid-range 28 of operation from 32 to 23 mm (10 mm) in response to approximately 5 mm of linear accelerator cable travel. The throttle valves 14 thus open a relatively greater number of degrees for a given linear distance of accelerator pedal travel (i.e., faster) during the pre-crossover mid-range 28 operation than during the off-idle range 42 operation. The progressively greater throttle valve velocity T of the control system 10 during the pre-crossover mid-range 28 operation provides good vehicle acceleration for lane changes and passing maneuvers.

Figure 4:
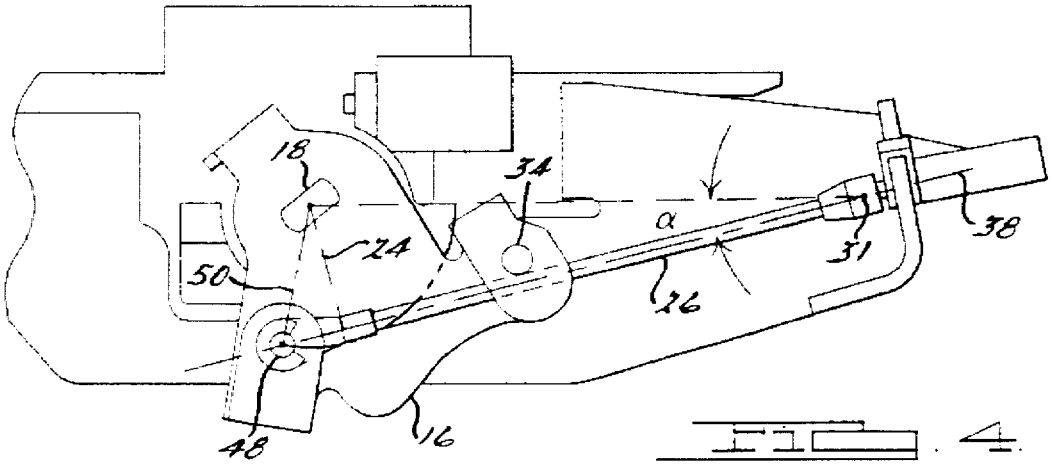
FIG. 4 is a front view of the Dual Radius Geometry Accelerator Control System of FIG. 2 showing the second radius of rotation at the cross-over condition as the accelerator cable disengages from the primary radius pull pin during mid-range maneuvers.
Figure 5:
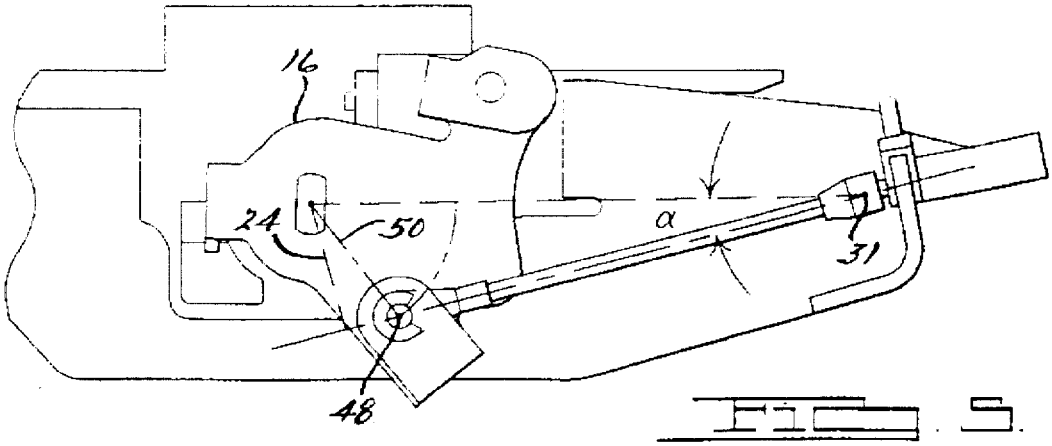
FIG. 5 is a front view of the Dual Radius Geometry Accelerator Control System of FIG. 2 showing the control member opening the throttle valves at a substantially linear actuation rate during the full-throttle range of operation.

Referring now to FIGS. 1A, 1B, 1C and 4, the primary radius pull pin 34 is rotated past the accelerator cable 26 at the radius of rotation cross-over point 46, a point which corresponds to 32.1 degrees of throttle valve shaft 18 rotation. Immediately thereafter, the control member 16 is pulled from a pull point 48 located at the centerline of the cable hitch 32. A second pull axis 38 is thus defined between the accelerator cable pivot point and the pull point 48. As the driver continues to depress the accelerator pedal, the pull point 48 is rotated along an arc defined by a second radius of rotation 50. A second moment arm 24 is created between the center axis of the throttle valve actuation shaft 18 and the new pull axis 38. As illustrated in FIG. 4, the length of the second moment arm 50 at any instant can be calculated as the sine of the angle alpha between the new pull axis 38 and the offset distance A, multiplied by the offset distance A.

The length of the second moment arm 24 begins to increase in post-crossover mid-range 52 operation effecting a corresponding decrease in the instantaneous throttle valve velocity T to open the throttle valves 14 more slowly. In the preferred embodiment, the throttle valves 14 open approximately 18 degrees (from 32.1 to 50 degrees) as the second moment arm 24 increases approximately 2 mm (from 23 to 25 mm) in response to approximately 8 mm of linear cable travel.

Referring now to FIGS. 1A, 1B, 1C and 5, the throttle valves 14 open 32 degrees (from 50 to 82 degrees) as the second moment arm 24 ranges 2 mm (between approximately 25 to 23 mm) in response to 15 mm of linear accelerator cable travel during the full-throttle range 54 of operation. The downshift circuit is actuated at approximately 60 degrees of throttle valve actuation shaft 18 rotation, a point denoted by numeral 56. The accelerator linkage introduces a discernable increase in the effort required to actuate the accelerator pedal just before the downshift point 46 giving notification to the driver that downshifting is about to occur. The length of the second moment arm 24 is advantageously maximized at the downshift point 56 thereby minimizing the throttle valve velocity T such that the throttle valves 14 open at a minimum actuation rate for the second radius of rotation 50 at the downshift point 56. After downshift point 56, the length of the second moment arm 50 again decreases effecting a corresponding increase in the actuation rate of the throttle valves 14. Thus, the throttle valves 14 open progressively faster until the control system 10 reaches wide-open throttle at approximately 82 degrees of throttle valve actuation shaft 18 rotation, a line denoted by numeral 58 in FIG. 1.

As shown in FIG. 1B, the conserved mechanical advantage of the second moment arm 50 allows the control system 10 to maintain a linear relationship between the travel of the accelerator cable 26 and the opening of the throttle valves 14 after downshifting has occurred which provides the driver with the perception of predictable and controllable acceleration as the system 10 approaches wide-open throttle at line 58.

In summary, as the engagement point 36 in FIG. 3 rotates about the throttle valve actuation shaft 18 along the arc traced by the first radius of rotation 40, the first moment arm 24 remains relatively long providing a slow instantaneous throttle valve actuation rate or throttle valve velocity T throughout the off-idle range 42. During mid-range 44 operation, the moment arm 24 decreases to its shortest length increasing the throttle valve velocity T to its maximum system value (i.e, opening the throttle valves 14 at the fastest rate for the control system 10) at the cross-over point 46 between the two radii of rotation 40 and 50. Finally, during the post-crossover mid-range 52 and the initial full-throttle range 54 of operation, the length of the second moment arm 24 increases from a minimum length at the cross-over point 46 to a maximum length for the second radius of rotation 50 at the downshift point 56. The throttle valve velocity T thus reaches a local minimum value at the downshift point 56 (i.e., the throttle valves 14 are open at the slowest rate within the range of the second radius of rotation 50 at the downshift point 56). In addition, the Dual Radius Geometry Accelerator Control System 10 advantageously provides sufficient a moment arm 24 of sufficient length, and therefore sufficient mechanical advantage, to provide the driver with the ability to modulate the opening of the throttle valves 14 during operation of the downshift circuit and as the control system 10 approaches wide-open throttle operation 58.

While the present invention has been disclosed in terms of the preferred embodiment thereof, one skilled in the art should understand that a variation made to the disclosed embodiment may still properly fall within the scope of the present invention as defined by the claims that follow.

What is claimed is:

1. An accelerator control system in a motor vehicle for controlling the opening of at least one throttle valve opened by the rotation of a shaft in response to the travel of an accelerator cable past a cable point, comprising:

control means, operably connected to said shaft to open said throttle valve and biased to maintain said throttle valve in a normally-closed position, said control means being rotatably fixed to said accelerator cable at a pull point that is spaced apart from said shaft at a first location on said control means, said first location being laterally opposite said cable point relative to said shaft when said throttle valve is in said normally-closed position; and guide means, fixed to said control means between said shaft and said cable point, for guiding said accelerator cable such that in a first range of pedal travel, said accelerator cable contacts said guide means at an engagement point to define a first draw line between said engagement point and said cable point, a first moment arm being defined from said throttle valve shaft to said first draw line, said first moment arm decreasing to minimum length as said accelerator cable is pulled past said cable point to open said throttle valve;

whereby in a second range of increasing accelerator pedal travel, a second draw line is defined between said pull point and said cable point, a second moment arm being defined from said throttle valve shaft to said second draw line, said second moment arm initially increasing in length and then decreasing in length as said accelerator cable is pulled continuously past said cable point to cause said pull point to travel to a second location between said shaft axis and said cable point.

2. A control system for a vehicle having a throttle valve actuated by an accelerator cable connected to an accelerator pedal, comprising:

a control member rotatably connected to the shaft of said throttle valve, said control member being biased to maintain said throttle valve in a normally-closed position and operable to open said throttle valve as said control member rotates about the axis of said throttle valve shaft;

an accelerator cable having proximal and distal ends, said proximal end rotatably fixed to said control member at a pull point and said distal end operably connected to said accelerator pedal through a pivot point, said pull point being spaced apart from said shaft at a location on said control member that is laterally opposite said pivot point relative to said shaft when said throttle valve is in said normally-closed position, a pull point radius of rotation being defined between the axis of said shaft and said pull point and a pull point axis being defined between said pivot point and said pull point; and a guide member fixed to said control member between said pull point and said pivot point, said accelerator cable engaging said guide member at an engagement point defining a fixed engagement point radius of rotation between the axis of said shaft and said engagement point and defining a guide member pull axis between said pivot point and said pull point;

wherein, as said accelerator pedal is depressed and said accelerator cable is pulled along said guide member pull axis to open said throttle valve, said engagement point travels along a first arc defined by said engagement point radius of rotation thereby creating a first moment arm, defined as the substantially perpendicular distance between said shaft axis and said guide member pull axis, said first moment arm decreasing in length until said accelerator cable disengages from said guide member, and after which; as said accelerator cable is pulled along said pull point axis to further open said throttle valve, said pull point travels along a second arc defined by said pull point radius of rotation thereby creating a second moment arm, defined as the substantially perpendicular distance between said shaft axis and said pull point axis, said second moment arm initially increasing in length and then decreasing in length as said accelerator cable is pulled past said pivot point and said pull point travels to a second location between said shaft axis and said pivot point.

3. A method for controlling the rate at which at least one throttle valve is opened in response to the linear travel of a cable attached to an accelerator pedal through a cable point, comprising the steps of:

providing a control member rotatably connected to the shaft of said throttle valve and operable to open said throttle valve as said control member rotates, said cable being rotatably attached to said control member at a draw point;

providing guide means connected to said control member between said shaft and said cable point to engage said cable at an engagement point defining a fixed first radius of rotation of said engagement point between the axis of said shaft and said engagement point and a first pull axis between said cable point and said draw point;

pulling said control member about said throttle valve shaft along said first pull axis such that a first moment arm, defined as the substantially perpendicular distance between the axis of said throttle shaft and said first pull axis, continuously decreases to a minimum length at a crossover point as said engagement point travels along the arc defined by said first radius of rotation; and pulling said control member about said throttle valve shah from said draw point defining a fixed second radius of rotation between said draw point and the axis of said shaft and a second pull axis between said draw point and said cable point such that a second moment arm, defined as the substantially perpendicular distance between the axis of said throttle valve shaft and said second pull axis, initially continuously increases then continuously decreases in length as said draw point travels along an arc defined by said second radius of rotation.

* * * * *